US005471707A

United States Patent [19]

Kang

[11] Patent Number: 5,471,707

[45] Date of Patent: Dec. 5, 1995

[54] ASSEMBLY FOR A VACUUM CLEANER HAVING A SOUND-ABSORBING SYSTEM

[75] Inventor: Sang B. Kang, Incheon, Rep. of Korea

[73] Assignee: Daewoo Electronics Co., Ltd., Seoul, Rep. of Korea

[21] Appl. No.: 249,217

[22] Filed: May 26, 1994

[30] Foreign Application Priority Data

May 29, 1993 [KR] Rep. of Korea ..... 93-9423

[51] Int. Cl.[6] ..... A47L 9/00

[52] U.S. Cl. ..... 15/326; 15/415.1; 181/229

[58] Field of Search ..... 15/326, 415.1; 181/224, 252, 256, 294, 230, 229

[56] References Cited

U.S. PATENT DOCUMENTS

| | | | |
|---|---|---|---|
| Re. 21,519 | 7/1940 | Norris | 15/326 |
| 2,223,353 | 12/1940 | Demaree | 15/326 |
| 2,260,237 | 10/1941 | Stahl | 15/326 |
| 2,330,701 | 9/1943 | Gerber | 15/326 |
| 2,929,462 | 3/1960 | Nowak | 15/326 |
| 4,015,683 | 4/1977 | Williams | 15/326 |
| 4,961,245 | 10/1990 | Barnes, Jr. et al. . | |

FOREIGN PATENT DOCUMENTS

| | | | |
|---|---|---|---|
| 0399433 | 11/1990 | European Pat. Off. . | |
| 3630710 | 3/1988 | Germany . | |
| 113173 | 10/1978 | Japan | 15/326 |
| 117262 | 10/1978 | Japan | 15/326 |
| 189321 | 7/1992 | Japan | 15/326 |
| 5049561 | 3/1993 | Japan . | |
| 402302 | 5/1966 | Switzerland . | |
| 951805 | 3/1964 | United Kingdom | 181/230 |

*Primary Examiner*—David Scherbel
*Assistant Examiner*—Tony G. Soohoo
*Attorney, Agent, or Firm*—Nixon & Vanderhye

[57] ABSTRACT

A brush assembly for a vacuum cleaner comprises a brush section including a suction opening and a suction space; a neck including a large-diameter section, the front part of which is inserted in the brush section, a cylindrical small-diameter section connected and incorporated to the large-diameter section through a shoulder, and a sound-absorbing material included in the large-diameter section and having a predetermined thickness, so that a cylindrical path is formed therein, which is interconnected to the suction space of the brush section; and a connector pipe including an expansion-pipe section, the diameter of which is enlarged so that the small-diameter section of the neck is interposed to be fixed in the expansion-pipe section, a cylindrical path formed therein, which is interconnected to the cylindrical path of the neck. According to the brush assembly, the noise generated in the connection part between the brush section and the suction pipe of the vacuum cleaner is greatly reduced, and thereby the entire noise of the cleaner is reduced.

4 Claims, 9 Drawing Sheets

■ TEST ROOM ; SEMI – UNECHOIC CHAMBER

■ AIR VELOCITY THROUGH SOUND ABSORBER (V)=58 m/sec

| L | SPL (dBA) |
|---|---|
| 70 | 67.5 |
| 80 | 65.0 |
| 95 | 63.5 |
| 105 | 63.0 |

t = 7.5 mm

SPL = SOUND PRESSURE LEVEL (dBA)

L = LENGTH OF ABSORBER (mm)

Di = 25 mm

Do = 40 mm r = 3 mm

V (AIR VELOCITY) = 58 m/sec

MATERIAL OF ABSORBER ; PVA SPONGE

| t | SPL (dBA) |
|---|---|
| 7.5 | 65.0 |
| 8.5 | 63.5 |
| 9.5 | 63.0 |
| 10.5 | 62.5 |

t = (Do−Di) / 2 (mm)

SPL = SOUND PRESSURE LEVEL (dBA)

L = 80 mm

Di = 25 mm

Do = OUT DIA. OF ABSORBER(mm)

r = 3 mm

V (AIR VELOCITY) = 58 m/sec

MATERIAL OF ABSORBER ; PVA SPONGE

ASSEMBLY FOR A VACUUM CLEANER HAVING A SOUND-ABSORBING SYSTEM

BACKGROUND OF THE INVENTION

1. Field of the Invention

The present invention relates to an assembly for a vacuum cleaner, and more particularly to an assembly for a vacuum cleaner, in the neck of which a sound-absorbing material is included, so that the noise generated at the connection part between the assembly and the suction pipe of the vacuum cleaner is reduced.

2. Prior Arts

A vacuum cleaner is an appliance, which generally includes a cleaner body, suction pipes, and an assembly, for cleaning an area by sucking the dirt with air into the cleaner body by means of the pressure difference between the interior and the exterior of the cleaner. In the cleaning operation of the cleaner with the above described construction, the dirt in an area to be cleaned is sucked into the assembly, and then accumulated in the cleaner body through the suction pipes. In this case, noise is greatly generated including the noise due to the flow of the air entraining the dirt through the assembly and the suction pipes, as well as the noise due to the operation of the motor included in the cleaner body in order to produce vacuum pressure in the cleaner body.

Therefore, it is an important technical object in a vacuum cleaner to reduce the noise generated in the operation of the cleaner, so there have been various efforts to resolve the above object. Especially, there have been various efforts to reduce the noise due to the flow of the air entraining the dirt in the cleaner, one among which is the suction pipe of U.S. Pat. No. 5,042,108 issued to Yamazumi et al. In the gazette of the patent, described is a suction pipe including an outer pipe 4, inner pipe 3, and a sound-absorbing material 5 between the inner and outer pipes, as shown in FIG. 1. Meanwhile, Yamazumi's suction pipe comprises a hollow cylindrical body 16 having sound-absorbing holes 15 on a ceiling portion thereof, the ceiling portion extending in the air-inducing direction; a cover 17 attached to the outer surface of the cylindrical body 16 to cover the ceiling portion; and a sound-absorbing material 18 disposed between the cover 17 and the ceiling portion, as shown in FIG. 2. Therefore, Yamazumi's suction pipe has a relatively small outer diameter so as to be easily handled, and also has excellent noise absorbing properties.

However, the above described prior arts focus their attention on sound absorbing or noise reducing only in the suction pipes, and do not present the reduction of noise generated in the assembly or in the connection pan between the assembly and the suction pipe, which can not be ignored in the entire operational noise of the cleaner. Meanwhile, as shown in FIG. 3, a conventional brush assembly of a vacuum cleaner comprises a brush section 31, a neck 32, and a connector 33 interconnected with a suction pipe. The sectional area of the air flow at the opening 32 of the brush section 31, which is the initial position that the air entraining the dirt is sucked, is relatively large, while the sectional area of the air flow in the suction pipe is relatively small, thereby the sucked air entraining the dirt experiences a severe air friction due to the compression or the vortex of the air because of the abrupt contraction of the sectional area of the air flow in passing through the neck 32 which is a connection part between the brush section 31 and the suction pipe.

Therefore, it is highly necessary to resolve the technical object to reduce noise generated at the connection part between the brush section and the suction pipe. However, no concrete solution has been discovered in prior arts including the above-described patent and the prior art thereof.

SUMMARY OF THE INVENTION

The present invention has been made to overcome the above technical objects, therefore the present invention aims to provide an assembly for a vacuum cleaner having a sound-absorbing system, in which the operational noise due to the air friction at the connection part between the assembly and the suction pipe is reduced.

To achieve the above object, the present invention provides a assembly for a vacuum cleaner having a sound-absorbing system comprising:

a section including a suction opening in order for the air entraining the dirt in the area to be cleaned to be sucked into the cleaner, and a suction space formed in the section in succession to the suction opening;

a neck including a relatively large-diameter section, a front part of which is inserted in the section, a shoulder connected and incorporated to the rear end of the large-diameter section, a cylindrical relatively small-diameter section connected and incorporated to the shoulder and having a diameter smaller than that of the large-diameter section, and a sound-absorbing member included in the large-diameter section and having a predetermined thickness, so that in the sound-absorbing member is formed a cylindrical path, which is interconnected to the suction space; and a connector pipe including an expansion-pipe section, which is deflected with respect to the other part of the connector pipe with a predetermined angle, and the diameter of which is enlarged compared with the other part of the connector pipe, so that the small-diameter section of the neck is interposed to be fixed in the expansion-pipe section, and a cylindrical path formed therein, which is interconnected to the cylindrical path of the neck.

Preferably, the sound-absorbing member included in the large-diameter section of the neck of the assembly according to the present invention may be a PVA sponge.

More preferably, the thickness of the sound-absorbing member may be larger than or equal to the difference between the radiuses of the large-diameter section and the small-diameter section, so that the diameter of the cylindrical path in the sound-absorbing member may be less than or equal to the diameter of the neck.

In cleaning, the air entraining the dirt is sucked through the suction opening, and then is progressed through the suction path consisting of the :suction space, the first cylindrical path, and the second cylindrical path. In this case, because the sectional area of the flow is abruptly contracted when the air is sucked from the suction space to the first cylindrical path, relatively large noise can be generated due to the air friction such as the compression or the vortex of the air. This noise is absorbed by the sound-absorbing member such as PVA sponge, which has superior sound-absorbing ability and is included in the large-diameter section of the neck. Therefore, the noise of the cleaner is reduced.

BRIEF DESCRIPTION OF THE DRAWINGS

The above object, and other features and advantages of the present invention will be apparent by describing the preferred embodiments of the present invention in detail hereinafter with reference to the accompanied drawings, in which.

DETAILED DESCRIPTION OF THE PREFERRED EMBODIMENT

Figure 1:
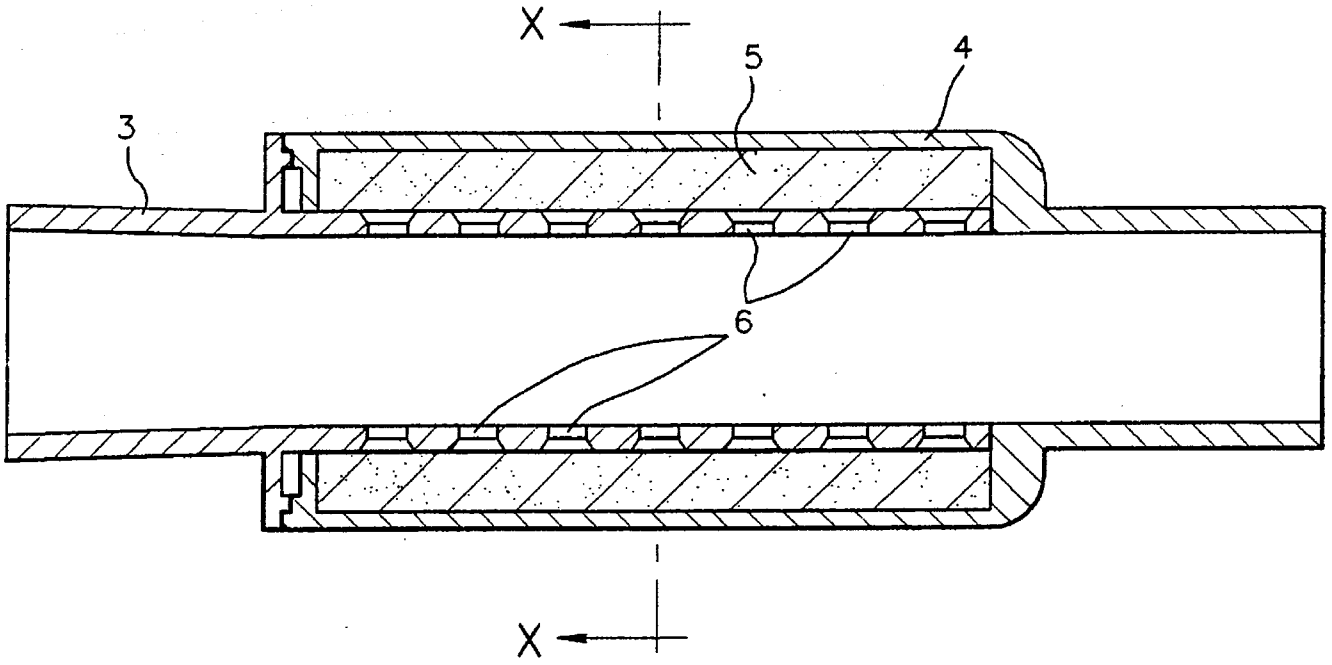
FIG. 1 (PRIOR ART)
FIG. 1 shows the sectional side elevation of a conventional suction pipe for a vacuum cleaner having a sound-absorbing system.
Figure 2:
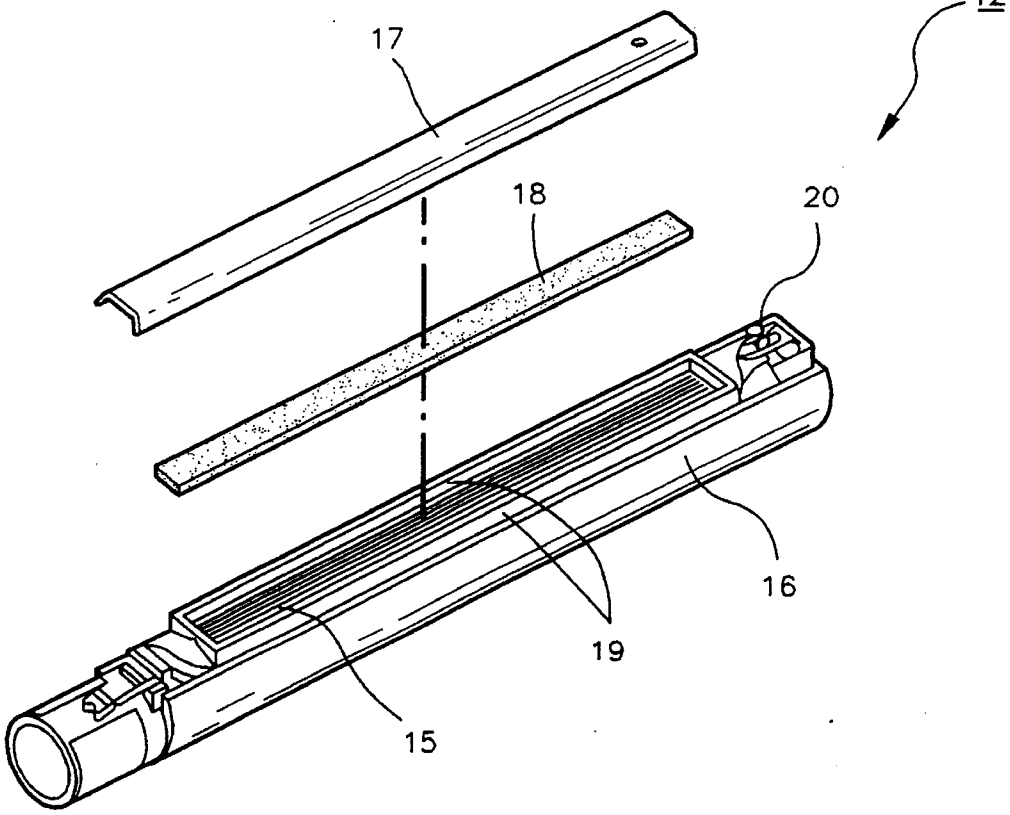
FIG. 2 (PRIOR ART)
FIG. 2 is a perspective exploded view of another conventional suction pipe for a vacuum cleaner having a sound-absorbing system.
Figure 3:
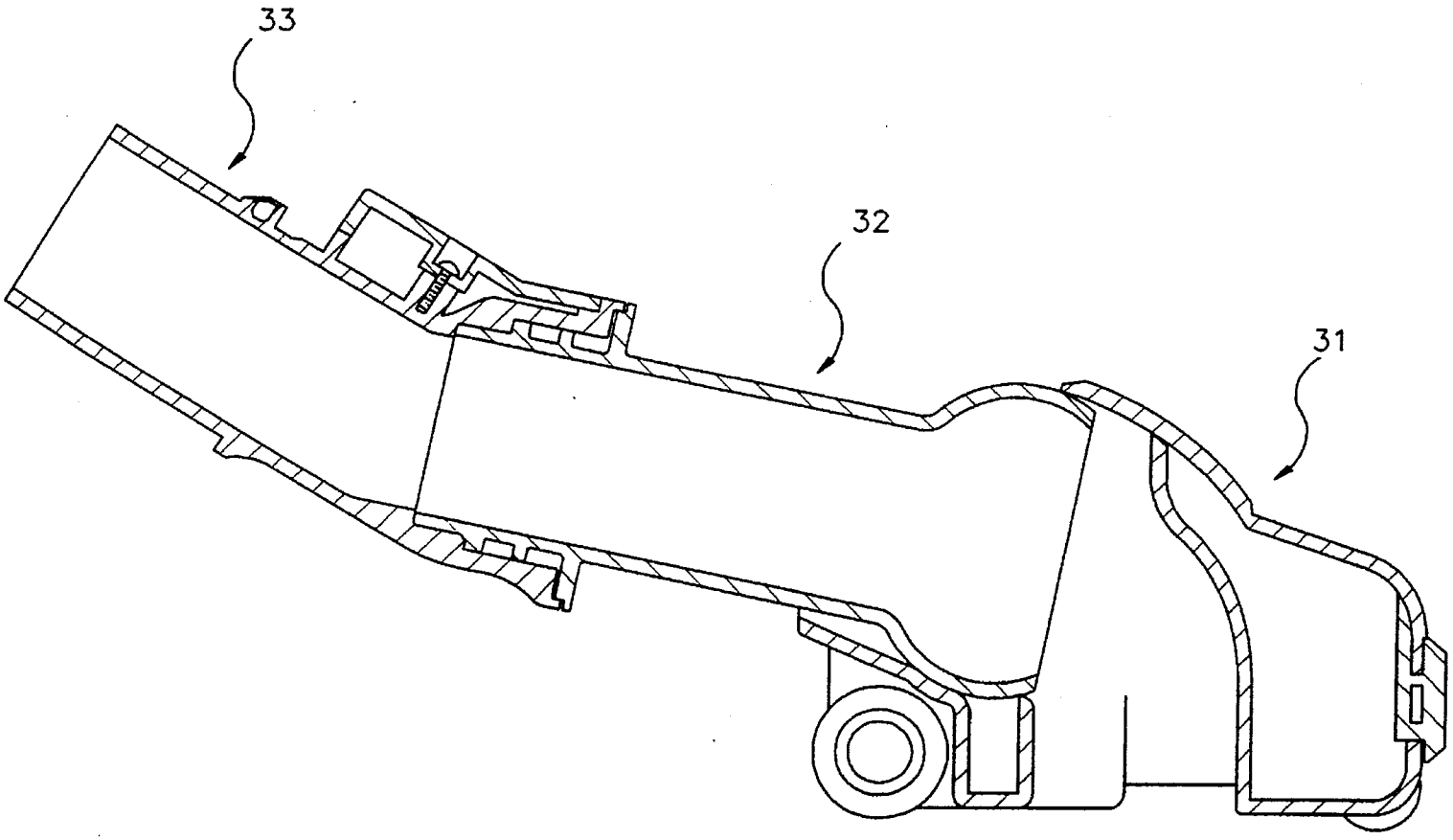
FIG. 3 (PRIOR ART)
FIG. 3 shows the sectional side elevation of a conventional brush assembly for vacuum cleaner.
Figure 4:
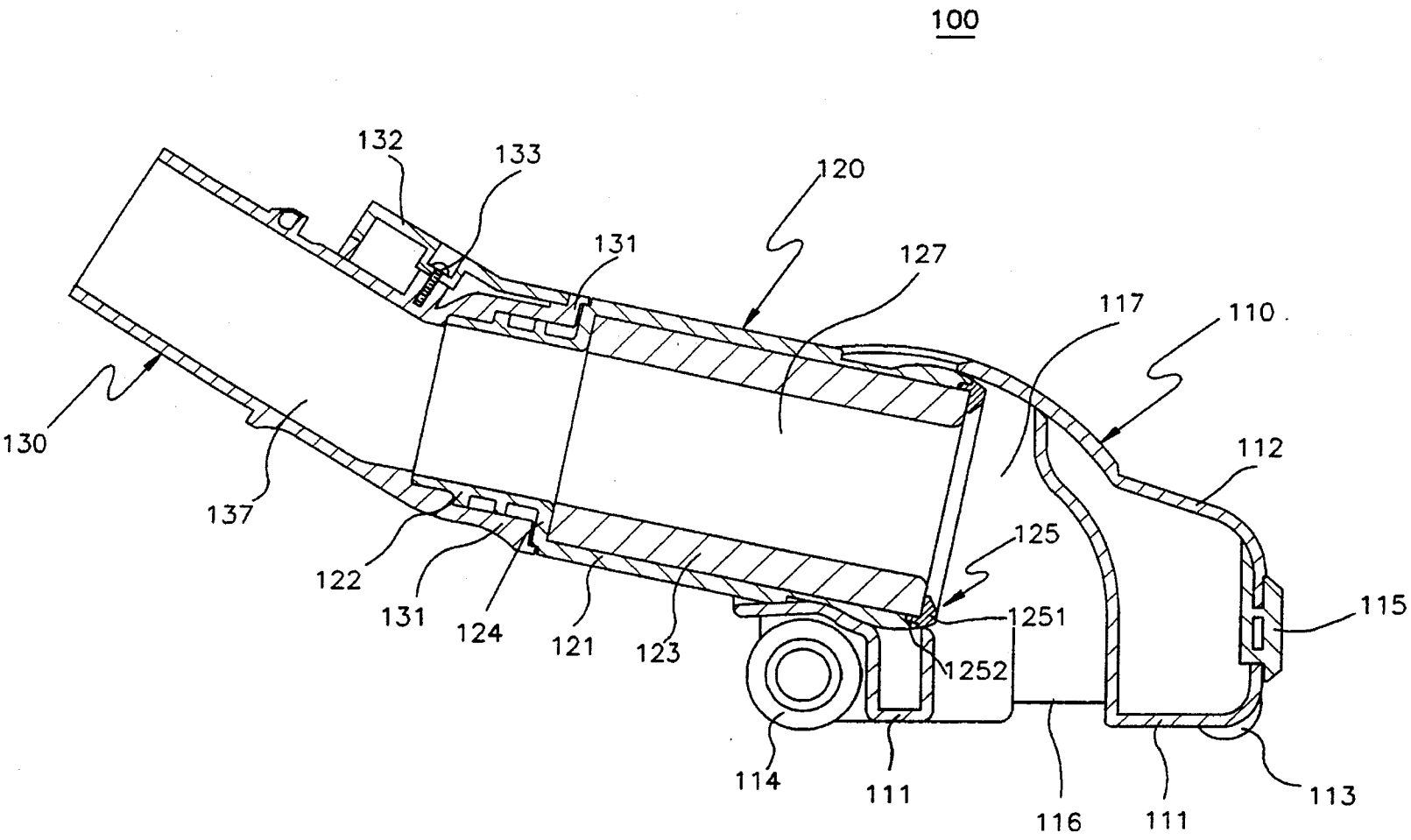
FIG. 4 shows the sectional side elevation of an assembly for a vacuum cleaner according to an embodiment of the present invention.
Figure 5:
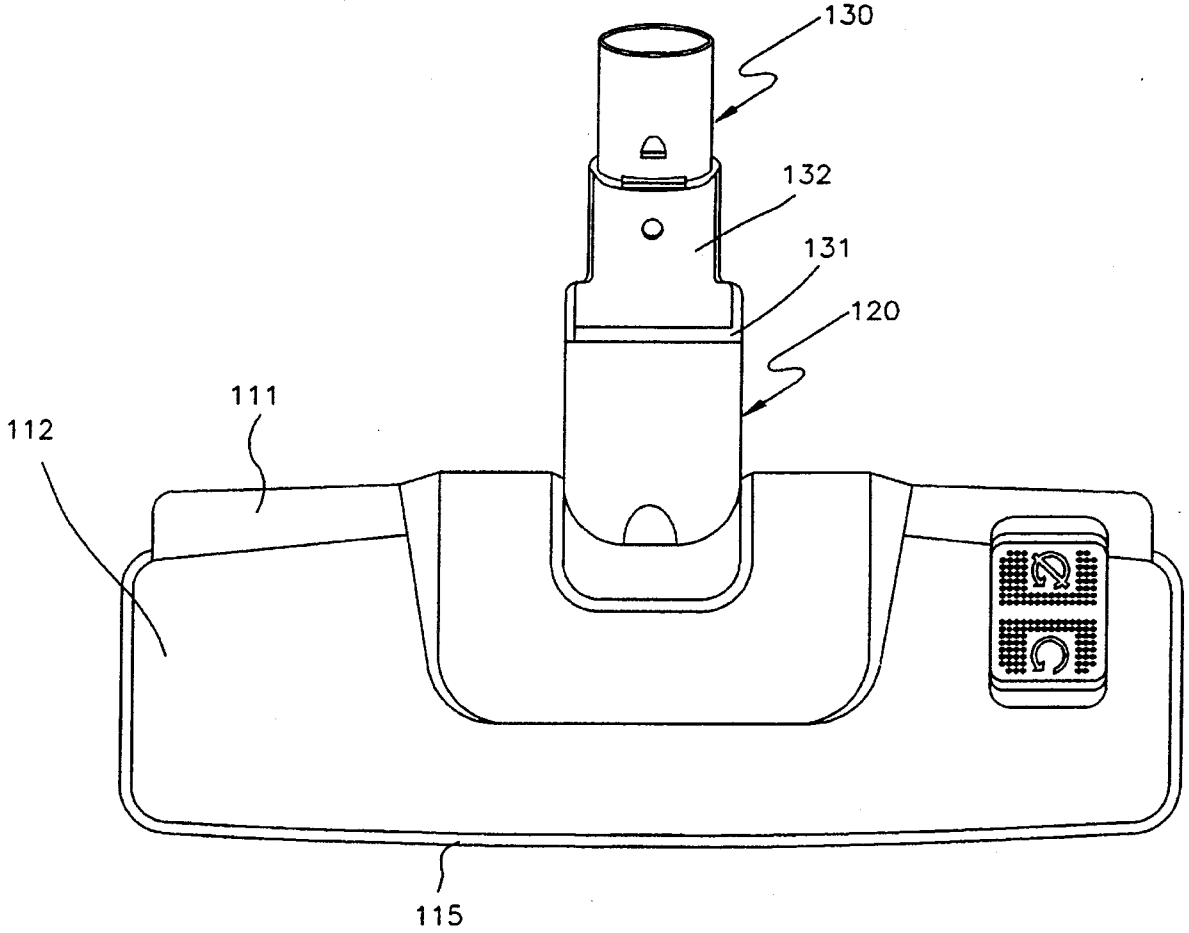
FIG. 5 is a plan view of the assembly shown in FIG. 4.

FIG. 4 shows the sectional side elevation of a assembly 100 for a vacuum cleaner having a sound-absorbing system according to an embodiment of the present invention.

The assembly 100 includes a section 110, a neck 120, and a connector pipe 130. The section 110 includes a body 111, at the front lower part of which are disposed front rollers 113, and at the rear lower part of which are disposed rear rollers 114, so that the section 110 can easily slide on the floor of the area to be cleaned. A cover 112 is assembled on the body 111, and a bumper 115 is interposed between the body 111 and the cover 112. Further, a suction opening 116, through which the dirt with air can be sucked, is formed at the lower part of the body 111, and a suction space 117 in the body 111 is connected directly thereto.

Meanwhile, a neck 120 includes a large-diameter section 121, a shoulder 124 incorporated thereto, and a small-diameter section 122 incorporated thereto in series, the front part of the large-diameter section 121 being interposed to be fixed between the rear part of the body 111 and the cover 112, and the small-diameter section 122 being inserted to be fixed in the connector 130. The front part of the large-diameter section 121 has proper shape so as to be interposed and fixed in the section 110, and the other part of the large-diameter section 121 and the small-diameter section 122 has cylindrical shape. Further, a sound-absorbing material 123 having predetermined thickness is fixed to the interior surface of the large-diameter section 121 by a stopper 125, so that in the sound-absorbing material is formed a first cylindrical path 127, which is interconnected to the suction space 117 of the section 110.

It is preferred that thickness of the sound-absorbing material 123 is larger than or equal to the depth of the shoulder 124 between the large-diameter section 121 and the small-diameter section 122.

Figure 6:
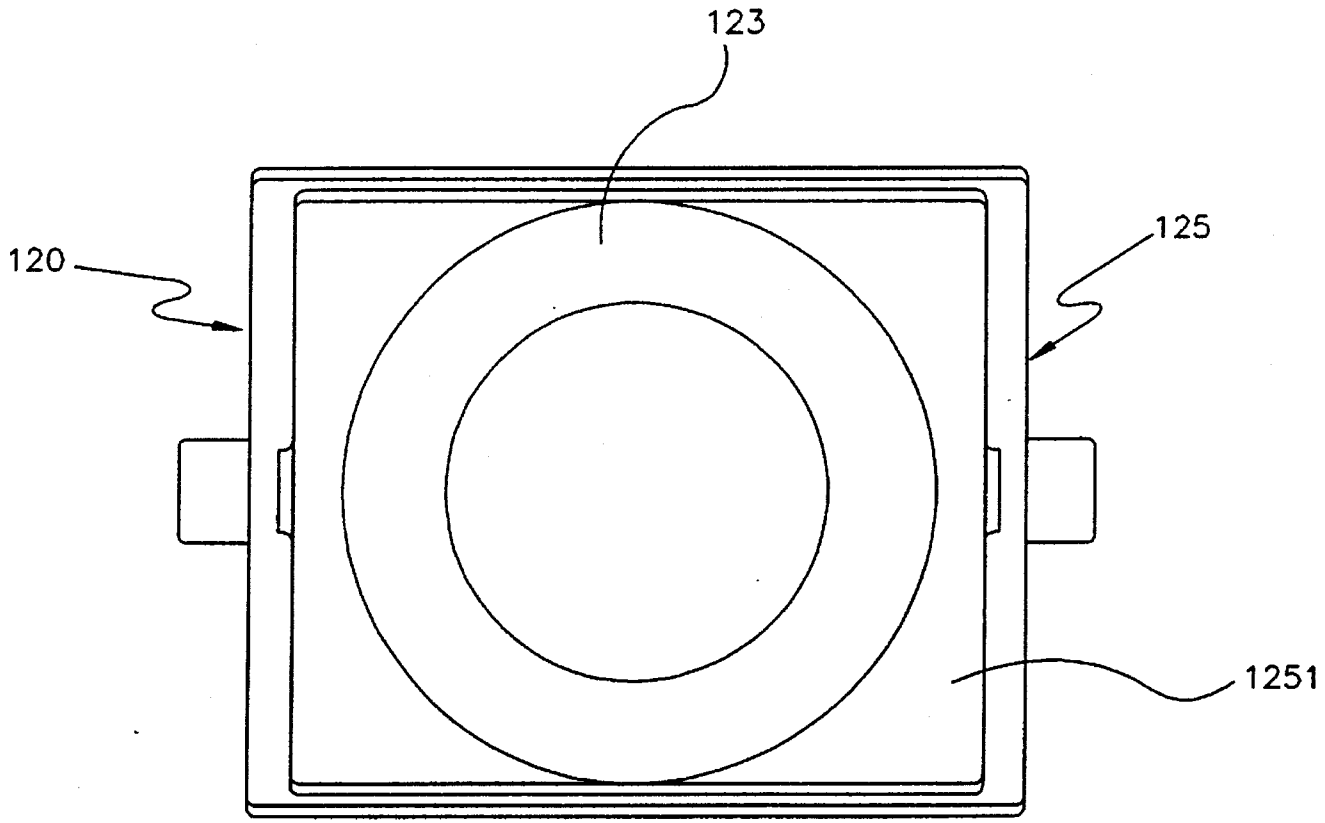
FIG. 6 is a front end view of the neck of the assembly shown in FIG. 4, showing the stopper assembled to the neck in order to fix a sound-absorbing member in the neck in detail.

In the presently preferred embodiment, the inner diameter of the first cylindrical path 127 in the sound-absorbing material 123 is equal to the inner diameter of the small-diameter section 122, and a Polyvinyl Alcohol (PVA) sponge is adopted as the sound-absorbing material. Further, at the front end of the large-diameter section 121 is disposed the stopper for fixing the sound-absorbing material 123, which includes a front section 1251 engaged with the front end of the sound-absorbing material 123 and a rear section 1252 engaged with the outer surface of the front end of the large-diameter section 121. The front section 1251 of the stopper 125 covers only an outer peripheral part of the front end surface of the sound-absorbing material 123, so that most of the air passing the front end of the neck does not contact with the stopper 125, but directly with the sound-absorbing material 123, as shown in FIG. 6. Furthermore, the inner comer of the front end of the sound-absorbing material 123 is rounded off with a predetermined curvature, so that the vortex of the air passing this front end can be reduced.

Meanwhile, the connector pipe 130 includes an expansion-pipe section 131 at the front part thereof, which is bent with respect to the other part of the connector pipe 130 with a predetermined angle, and the diameter of which is larger than the other part of the connector pipe 130.

The small-diameter section 122 of the neck 120 is interposed to be fixed in the expansion-pipe section 13 1, and a connector cover 132 is fixed on the expansion-pipe section 131 by a bolt 133. In the connector 130 is formed a second cylindrical path 137 with a predetermined diameter, which is interconnected to the first cylindrical path 127 in the neck 120, thereby a suction path consisting of the suction opening 116, the suction space 117, the first cylindrical path 127, and the second cylindrical path 137, which are connected in series.

Meanwhile, PVA sponge, which is adopted as a sound-absorbing material included in the large-diameter section 121 of the neck 120 in the presently preferred embodiment, has a continuous porous structure.

That is, PVA sponge is a complete open cell sponge and each of its pores are not independent but interconnected, unlike the urethane sponge or rubber sponge made by a gas pore forming treatment. Therefore, the PVA sponge has high filtering efficiency, excellent wet state elasticity, superior durability, high resistance to chemicals, and easily-colored characteristic, and further it has superior sound-absorbing ability. In other embodiments of the present invention, other materials having a continuous porous structure to provide superior sound-absorbing ability can be adopted as ,a sound-absorbing material included in the large-diameter section 121.

In cleaning, the air entraining the dirt flows as follows in the assembly according to the present invention including the construction as described above. That is, the air entraining the dirt is sucked through the suction opening 116, and then passes through the suction path consisting of the suction space 117, the first cylindrical path 127, and the second cylindrical path 137.

In this case, because the sectional area of the flow is abruptly contracted when the air is sucked from the suction space 117 to the first cylindrical path 127, relatively large noise can be generated due to the air friction such as the compression or the vortex of the air. This noise is absorbed by the sound-absorbing material such as PVA sponge, which has superior sound-absorbing ability as described above and is included in the large-diameter section 121 of the neck 120 according to the present invention.

A test for the sound-absorbing effect of the assembly according to the present invention as described above was performed, and the condition and the result of the test will be described hereinafter in detail referring to FIGS. 7 to 9(*b*).

Figure 7:
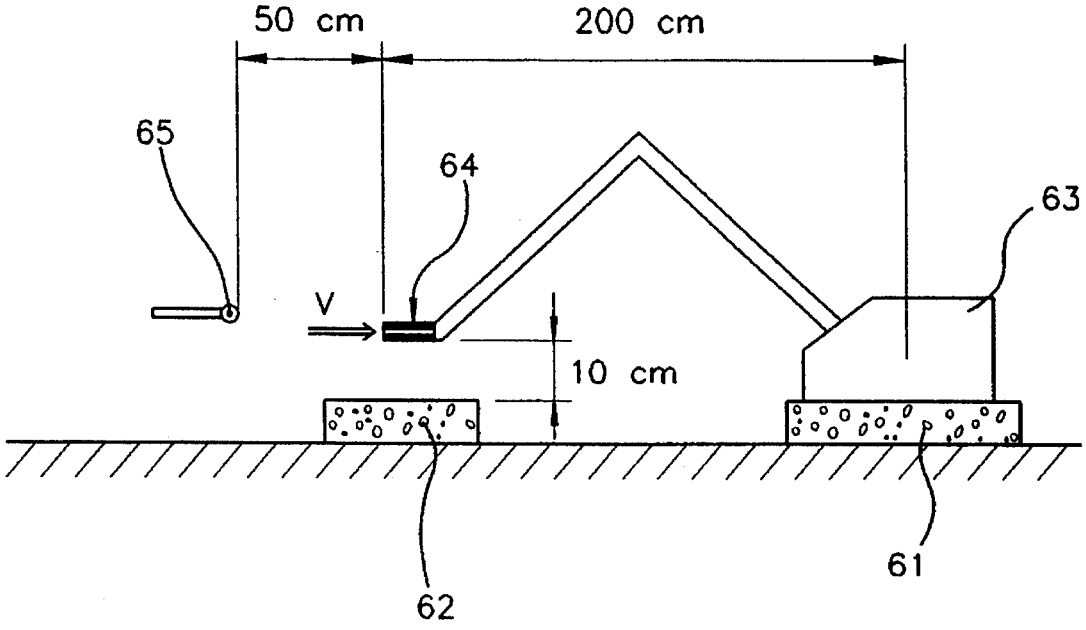
FIG. 7 shows an arrangement of a vacuum cleaner including an assembly according to the present invention and the test condition in order to test the: noise-reduction effect of a vacuum cleaner including an assembly according to the present invention.

As shown in FIG. 7, the test was performed in an anechoic chamber, the air velocity sucked into the assembly 64 was 58 m/sec. The cleaner body was disposed on a urethane foam 61 put on a proper position of the floor of the area to be cleaned, and the assembly 64 including a sound-absorbing material of PVA sponge in the neck thereof was disposed 10 cm above another urethane foam 62 put on a position 2 m departed from the cleaner body 63. A microphone was disposed 50 cm departed forward from the assembly 64, and the noise level was measured by the microphone 65.

Figure 8:
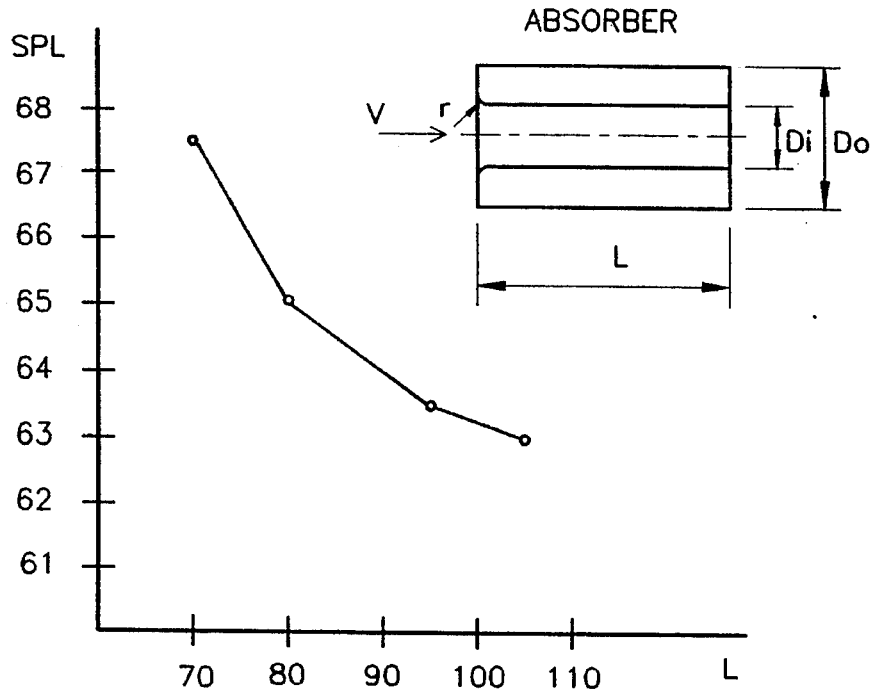
FIG. 8(*a*) shows a graph and FIG. 8(*b*) shows a table to describe the noise-reduction effect with respect to the length of the sound-absorbing material in the test according to the arrangement and the condition shown in FIG. 7.
Figure 9:
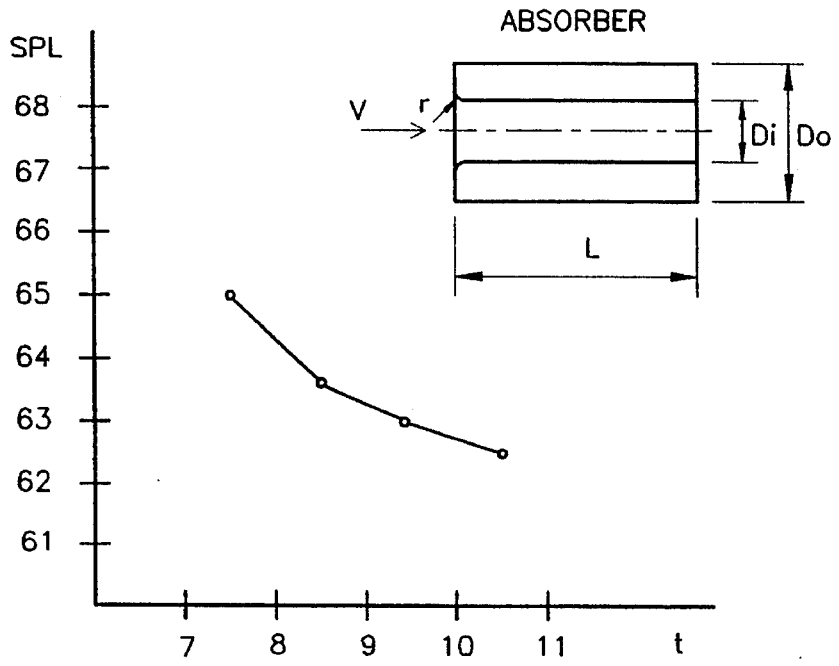
FIG. 9(*a*) shows a graph and FIG. 9(*b*) shows a table to describe the noise-reduction effect with respect to the thickness of the sound-absorbing material in the test according to the arrangement and the condition shown in FIG. 7.

Under this condition, the noise levels corresponding to various lengths of the PVA sponge sound-absorbing material included in the neck of the assembly are shown in FIG. 8(*a*), and 8(*b*) and the noise levels corresponding to various thicknesses of the sound-absorbing material are shown in FIG. 9(*a*), and 9(*b*) in which Di designates the inner diameter of the cylindrical path formed in the sound-absorbing material, and Do designates the outer diameter of the sound-absorbing material which is the inner diameter of the large-diameter section of the neck.

From FIG. 8(*a*), and 8(*b*) it can be found that, the longer the sound-absorbing material is, the lower the noise level is, when the thickness of the sound-absorbing material is constant, which is 7.5 mm in the present test. Further, FIG. 9(*a*) and 9(*b*) shows that, the thicker the sound-absorbing material is, the lower the noise level is, when the length of the sound-absorbing material is constant, which is 80 mm in the present test. In other words, the test shows that the longer and the thicker the sound-absorbing material is, the larger the noise-reduction effect is.

According to the construction of the present invention as described above, the noise generated due to the air friction happening when the air entraining the dirt passes through the neck of the assembly, which is a part that the sectional area of the air flow abruptly changes, in the course of being sucked into the cleaner body, is absorbed by the sound-absorbing material included in the neck of the assembly, so that the noise in the assembly, which takes a considerable place of the entire noise of the cleaner, is reduced. Accordingly, the entire noise of the cleaner is reduced. Further, especially in case that the sound-absorbing material is a PVA sponge, the noise-reduction effect in the cleaner is excellent due to the superior sound-absorbing ability of the PVA sponge.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An assembly for a vacuum cleaner having a sound-absorbing system comprising:

a body including a suction opening in order for the air entraining dirt in an area to be cleaned to be sucked into the cleaner, and a suction space formed in the body adjacent to the suction opening;

a neck including a relatively large-diameter section, said large-diameter section having a front part, said front part inserted in the body, a shoulder connected to a rear end of the large-diameter section, a cylindrical relatively small-diameter section connected to the shoulder and having a diameter smaller than that of the large-diameter section, a PVA, polyvinyl alcohol, sponge located within the large-diameter section and having a predetermined thickness so that said PVA sponge has a first cylindrical path formed therein which is interconnected with said suction space, and a stopper having a front section engaged with said PVA sponge and a rear section engaged with an outer surface of said large-diameter section, the thickness of said PVA sponge being not less than the difference between radiuses of said large-diameter section and said small-diameter section of the neck, so that said first cylindrical path has a diameter not greater than the diameter of said small-diameter section of the neck, said PVA sponge having an inner corner rounded off so as to have a predetermined curvature, and said front section of said stopper covering an outer peripheral part of a front end surface of said PVA sponge; and a connector pipe including an expansion-pipe section and a remaining-pipe section, said expansion pipe section is bent with respect to the remaining-pipe section with a predetermined angle, and the diameter of said expansion-pipe section is enlarged compared with the remaining-pipe section, the small-diameter section of the neck is locatable in the expansion-pipe section, and said connector pipe having a second cylindrical path formed therein, which is interconnected to the first cylindrical path of the neck.

2. The assembly as claimed in claim 1, wherein the PVA sponge has a continuous porous structure.

3. The assembly as claimed in claim 1, wherein said body further comprises front rollers disposed at a front lower part of said body and rear rollers disposed at a rear lower part of said body so that said body may easily slide on a floor of an area to be cleaned.

4. The assembly as claimed in claim 1, wherein an inner diameter of the first cylindrical path is equal to an inner diameter of the small-diameter section.

* * * * *